US010413838B2

(12) United States Patent
Chu

(10) Patent No.: US 10,413,838 B2
(45) Date of Patent: Sep. 17, 2019

(54) CHASSIS STRUCTURE OF REMOTE CONTROL CRAWLER VEHICLE

(71) Applicant: Daimler Chu, New Taipei (TW)

(72) Inventor: Daimler Chu, New Taipei (TW)

( * ) Notice: Subject to any disclaimer, the term of this patent is extended or adjusted under 35 U.S.C. 154(b) by 2 days.

(21) Appl. No.: 15/654,670

(22) Filed: Jul. 19, 2017

(65) Prior Publication Data

US 2019/0022540 A1 Jan. 24, 2019

(51) Int. Cl.
*A63H 17/26* (2006.01)

(52) U.S. Cl.
CPC ..... *A63H 17/262* (2013.01); *A63H 17/264* (2013.01)

(58) Field of Classification Search
CPC .... A63H 17/00; A63H 17/004; A63H 17/262; A63H 17/264
See application file for complete search history.

(56) References Cited

U.S. PATENT DOCUMENTS 4,146,109 A * 3/1979 Barth ..... B62D 7/00 180/420
4,647,067 A * 3/1987 Paquette ..... B60G 21/04 280/124.111
4,696,655 A * 9/1987 D'Andrade ..... A63H 17/262 446/466
4,850,929 A * 7/1989 Genevey ..... A63H 17/262 446/466
6,036,575 A * 3/2000 Rehkemper ..... A63H 17/262 446/437
6,767,272 B2 * 7/2004 Santarsiero ..... A63H 17/004 446/437
2002/0077026 A1 * 6/2002 Li ..... A63H 17/262 446/466

* cited by examiner

*Primary Examiner* — Eugene L Kim
*Assistant Examiner* — Alyssa M Hylinski
(74) *Attorney, Agent, or Firm* — Leong C. Lei

(57) ABSTRACT

A chassis structure of a remote control crawler vehicle includes front and rear swing arm assemblies mounted symmetrically on a frame at two sides of a central separation driving box and respectively connected to front and rear bridges of the frame. The front and rear swing arm assemblies are each pivotally connected to the frame by means of a swing arm seat. The swing arm seat is formed with an axle hole extending in a vehicle body direction and having two ends each combined with a bearing for rotatably receiving and supporting a bridge swing arm. An opposite end of each bridge swing arm is mounted to the front and rear bridges so as to form a novel chassis structure of a remote control crawler vehicle. In this way, the front and rear bridges are allows to take up and down swings in a one-axis manner of movement.

5 Claims, 6 Drawing Sheets

CHASSIS STRUCTURE OF REMOTE CONTROL CRAWLER VEHICLE

TECHNICAL FIELD OF THE INVENTION

The present invention relates generally to a chassis structure of a crawler vehicle, and more particularly to a chassis structure formed of swing arm assemblies that are design in a manner of single axis flexing swing and is applicable to remote control toy crawler vehicle and a structure of a crawler vehicle for driving by a real person.

DESCRIPTION OF THE PRIOR ART

Remote control model cars are products that are popular in the general consumers. They can be classified in three categories according to the orientations of design of vehicle body structure. The first one is racing cars that focus on speed and are designed for running on paved surfaces to allow user to enjoy the pleasure of control of operations at high speeds. Another category is off-road cars, which feature operability of large acceleration and flexibility of movement and are capable of flying and leaping on off-road racing trails and are the most popular models recently. The other category is the so-called big-foot vehicles that generally include the recently prevailing crawler vehicles, which feature designs of large torque output and highlight the huge size of wheels and twistable chassis design, making it not readily susceptible to constrains of uneven ground surfaces and providing better capability of creating moving path to crawl in uneven rocky stack, rock barriers, or obstacles, exhibiting excellent operability of control, and also allowing for enjoy of exaggerative swing of the suspension system, achieving a different type of pleasure of remote control vehicles, and thus greatly welcome by the general consumers.

Most of the toy crawler vehicles that are currently available in the market have a chassis that is designed with a multiple link configuration, in which multiple link rods are connected with spherical joints at two ends thereof and are fixed between a vehicle frame and front and rear bridges. When wheels move over uneven road surfaces, the spherical joints of the link rods allows the front and rear bridges to swing up and down or twist and swing leftward and rightward in order to keep the wheels as close to the ground surface as possible for crawling. However, in such designs, since the connection points of the link rods are not on the same site, when the bridges twist and swing, the link rods mutually constrain each other such that swings can only be conducted in a "smile" fashion. This causes quick wear and abrasion between the link rods and the spherical joints to generate gaps and may also leads to stress concentration that causes breaking and damages.

Further, such a multiple link type chassis design makes the connection points between the link rods and the frame not located on the same axis as a universal joint point between a transmission axle and a separation driving box, so that when the bridges swing up and down, a distance between a differential of the bridges and a universal joint of the separation driving box the varies. Thus, crawler vehicles of such designs require a two-stages, extendible transmission axle. However, such a transmission axle is expensive and has poor durability.

The above described features and drawbacks of the toy crawler vehicle are also exhibited in a crawler car driven by a real person. Thus, although the present invention is described and illustrated with a toy crawler vehicle as an example, the present invention is equally applicable to a crawler car made for driving by a real person.

SUMMARY OF THE INVENTION

The primary objective of the present invention is to provides a chassis structure of a remote control crawler vehicle, which allows front and rear bridges to exhibit up and down and twisting flexing swings through single axis movement so as to enhance the structure of the entirety of the chassis and also improve durability of parts.

Another objective of the present invention is to provide a chassis structure of a remote control crawler vehicle, which allows, during swing of front and rear bridges, a distance between a differential a universal joint point of a separation driving box to be kept constant as that connection can be made with one-rod transmission axle that is of high durability and low cost.

To achieve the above objectives, the present invention provides a chassis structure of a remote control crawler vehicle, which comprises front and rear swing arm assemblies mounted, in a symmetric manner, on a frame at two sides of a central separation driving box and respectively connected to front and rear bridges of the frame, and is characterized in that each of the swing arm assemblies comprises a swing arm seat, an axle, and a bridge swing arm, wherein the swing arm seat is formed, in a center thereof, an axle hole along a vehicle body direction, the axle hole receiving and combined therein with bearings, the swing arm seat comprising pivotal coupling sections provided in radial directions on two opposite sides of the axle hole and each comprising a pivot connection hole formed therein to be pivotally connected to the frame by means of pivots; the bridge swing arm has an end that is coupled, through an axle, in the axle hole of the swing arm seat and an opposite end that is formed with two support arms extending outwards to show a V-shape, the support arms each having an end forming a coupling section for coupling with the front and rear bridges; wherein up and down or twisting swing of the front and rear bridges is exhibited in a single axis manner by means of the front and rear swing arm assemblies.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
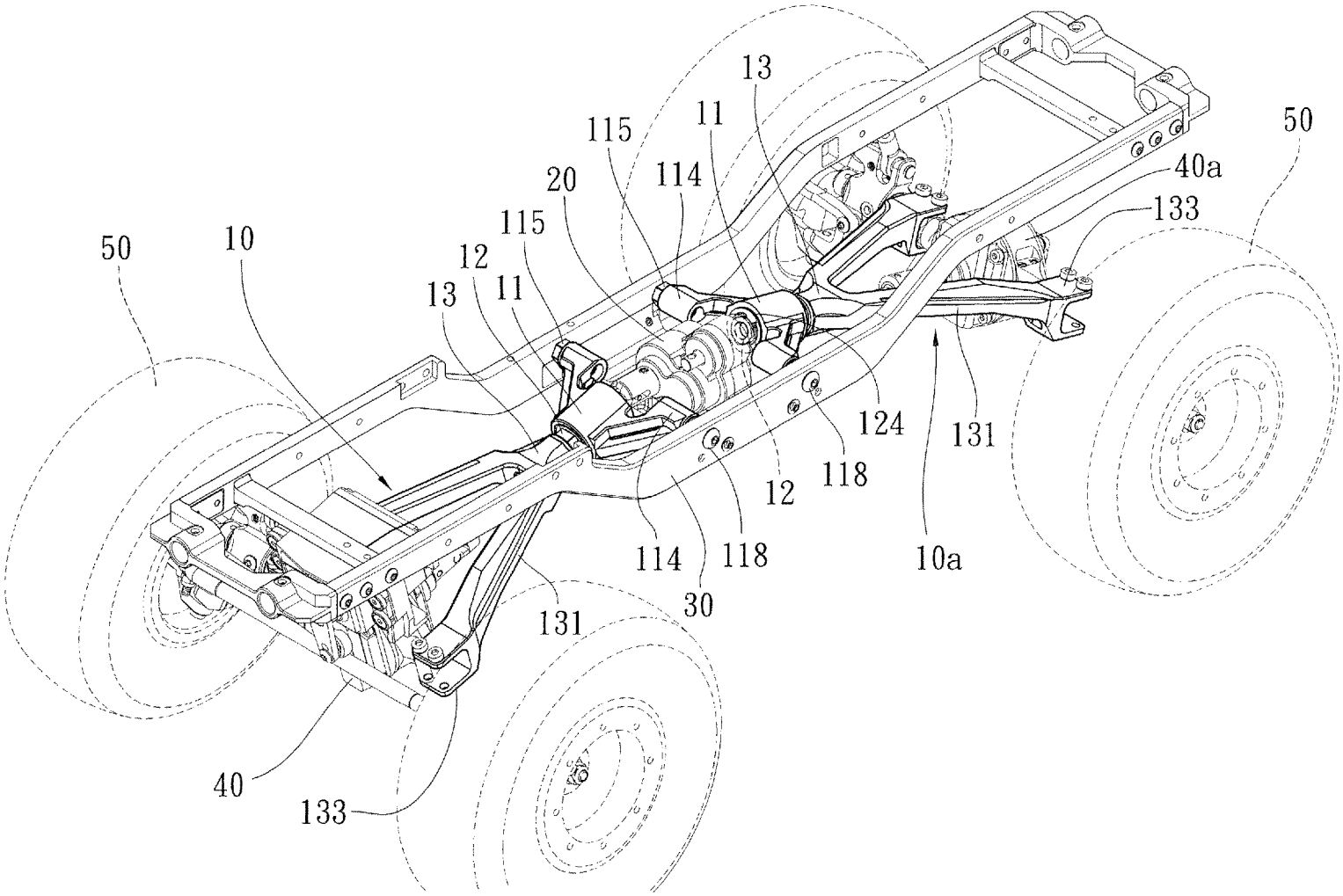
FIG. 1 is a perspective view of the present invention.
Figure 2:
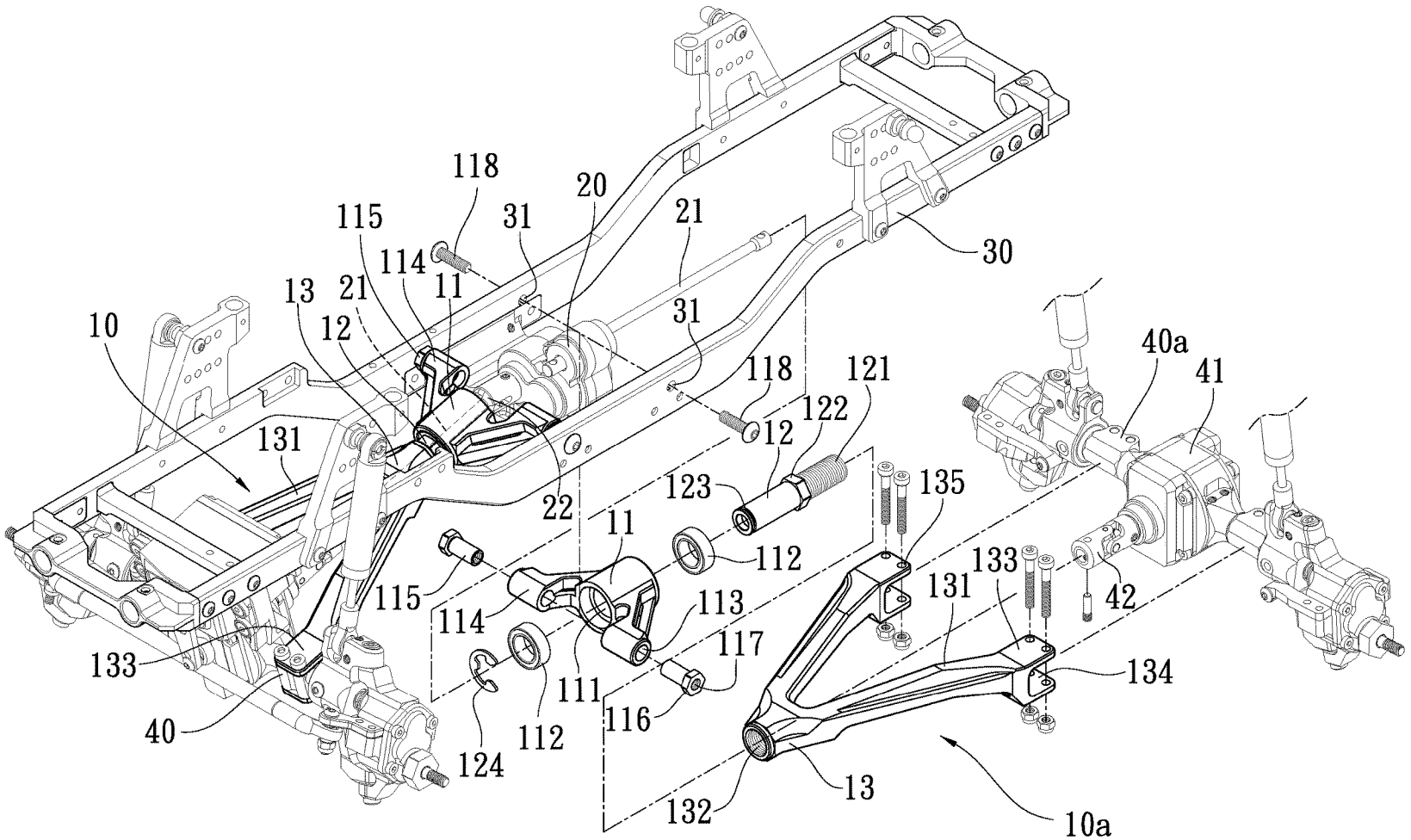
FIG. 2 is an exploded view of a structure of the present invention.
Figure 3:
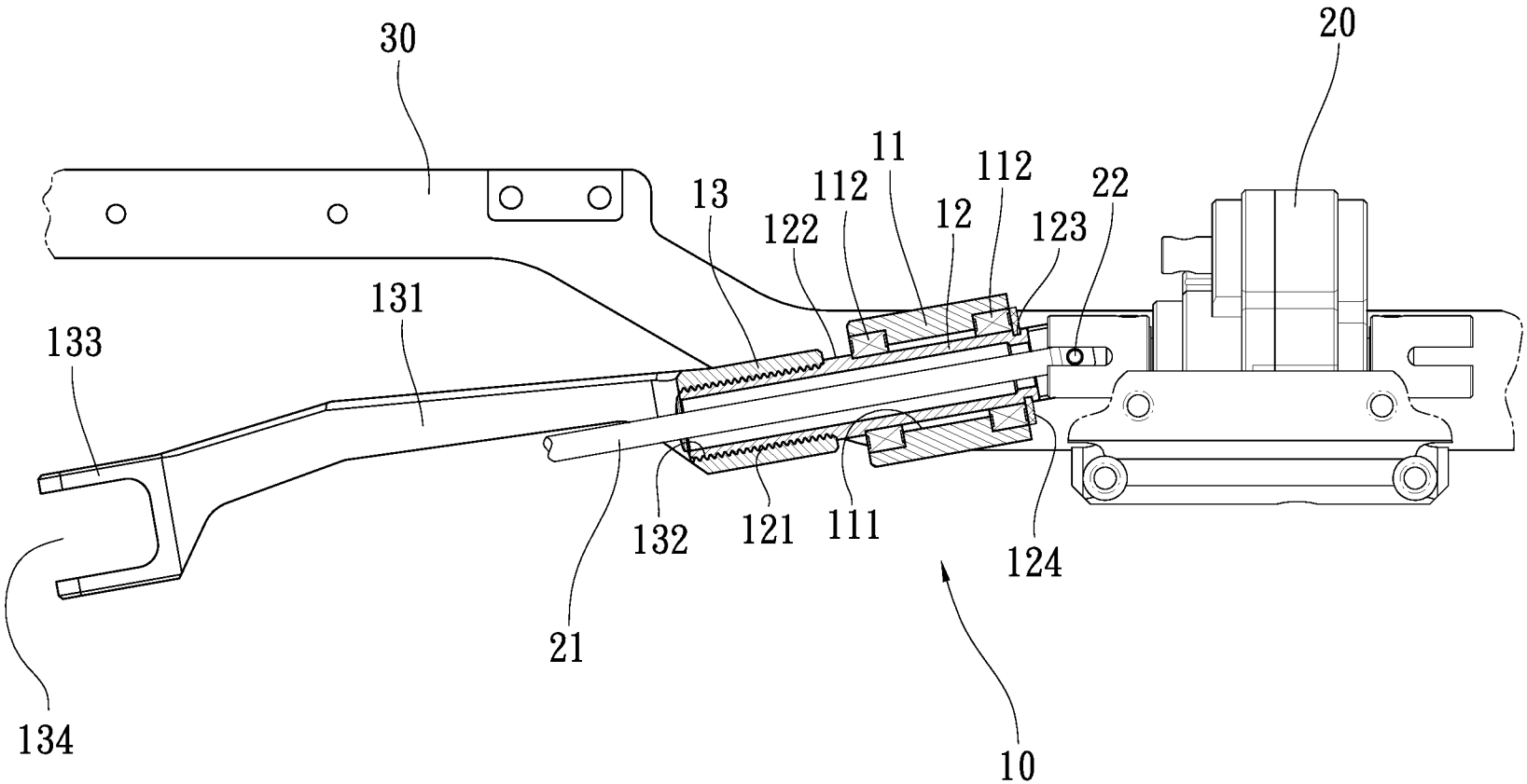
FIG. 3 is a cross-sectional view showing a part of the structure of the present invention.

Referring to FIGS. 1-3, the present invention provides a chassis structure of a remote control crawler vehicle, which generally comprises a front swing arm assembly 10 and a rear swing arm assembly 10*a*. The swing arm assemblies (10, 10*a*) are mounted on a frame 30, respectively at front and rear sides of a centrally-located separation driving box 20, in a symmetric manner, to respectively couple to a front bridge 40 and a rear bridge 40*a*.

The two swing arm assemblies (10, 10*a*) are each made up of a swing arm seat 11, an axle 12, and a bridge swing arm 13, wherein the swing arm seat 11 is formed, in a center thereof, an axle hole 111 along a vehicle body direction. The axle hole 111 has two opposite ends each combined with a bearing 112. The swing arm seat 11 is provided, on external thereof, with pivot coupling sections 114 respectively extending in radial directions of the axle hole 111 from two opposite sides thereof and each comprising a pivot connection hole 113 formed therein to allow for pivotal connection, by means of a pivot, of the swing arm 11 to the frame 30 in an up and down swingable manner. In the preferred embodiment, the two sides are arranged such that each of the pivot connection holes 113 is fit to a sleeve 115, wherein the sleeve 115 has an outer circumference that comprises a clamping section 116 projecting therefrom and an interior in which an internal thread 117 is formed. A bolt 118 penetrates through a locking hole 31 formed in the frame 30 and screwed into the internal thread 117 formed in the interior of the sleeve 115 to allow the swing arm seat 11 to pivotally connect to the frame 30.

The axle 12 is a hollow tubular body and the tubular body has an end having an external surface in which an external threaded section 121 is formed. A force application section 122 is provided, in a raised form, adjacent to one side of the external threaded section 121 for engagement with and clamping by a tool. The tubular body has an opposite end that is provided with a clip groove 123 in the form of a circumferential recess at a location close to an end face. The end with the clip groove 123 is inserted into the axle hole 111 of the swing arm seat 11 to couple with the two bearings 112 in a generally co-axial manner and is fixed therein and coupled thereto by having an axle clip 124 set in the clip groove 123.

The bridge swing arm 13 is in the form of a V-shape and comprises two support arms 131 extending outwards. A common joint portion of the two support arms 131 is provided with a threaded hole 132, which is screwed to the external threaded section 121 of the axle 12 to achieve pivotal connection of the bridge swing arm 13 and the swing arm seat 11, such that the two sideways support arms 131 may be rotated through the axle 12. Further, each of the support arms 131 is provided, on an end thereof, with a coupling section 133, and in the instant embodiment, the coupling section 133 is made in the form of a U-shaped clamping slot 134. The clamping slot is provided with penetrating coupling holes 135, so that bolts may be used to joint and fix the front and rear bridge (40, 40*a*) together. As such, a novel chassis structure of a remote control crawler vehicle is formed.

Further, since the bridge swing arm 13 is coupled, in a rotatable manner through the axle 12, to the axle hole 111 of the swing arm seat 11, the axle 12 may alternatively be integrally formed, in an outward projecting manner, on the rotatable jointing end of the bridge swing arm 13 to allow the bridge swing arm 13 to be directly and rotatably mounted to the swing arm seat 11.

Further, in other embodiments of the present invention that are not shown in the drawings, the connection points between the locking holes 31 of the frame 30 and the transmission axle 21 of the separation driving box 20 can be designed and set on a common axis (not shown) so that when the swing arm seat 11 is rotatably mounted to the frame 30, the rotation axis of the swing arm seat 11 is set on the same axis of the connection points of the transmission axle 21 of the separation driving box 20 and when the front and rear bridges (40, 40*a*) undergo up-and-down swings, a distance between a connection point of a universal joint 42 of a differential 41 and the connection points 22 of the transmission axle 21 of the separation driving box 20 can be permanently kept as a constant. With such an arrangement, a highly durable and low cost, fixed length, single rod type transmission axle 21 may be used, so that by means of penetration, the hollow axle 12 may extent through and couple between the separation driving box 20 and the differential 41 of the front and rear bridges (40, 40*a*) for stable transmission of power.

Figure 4:
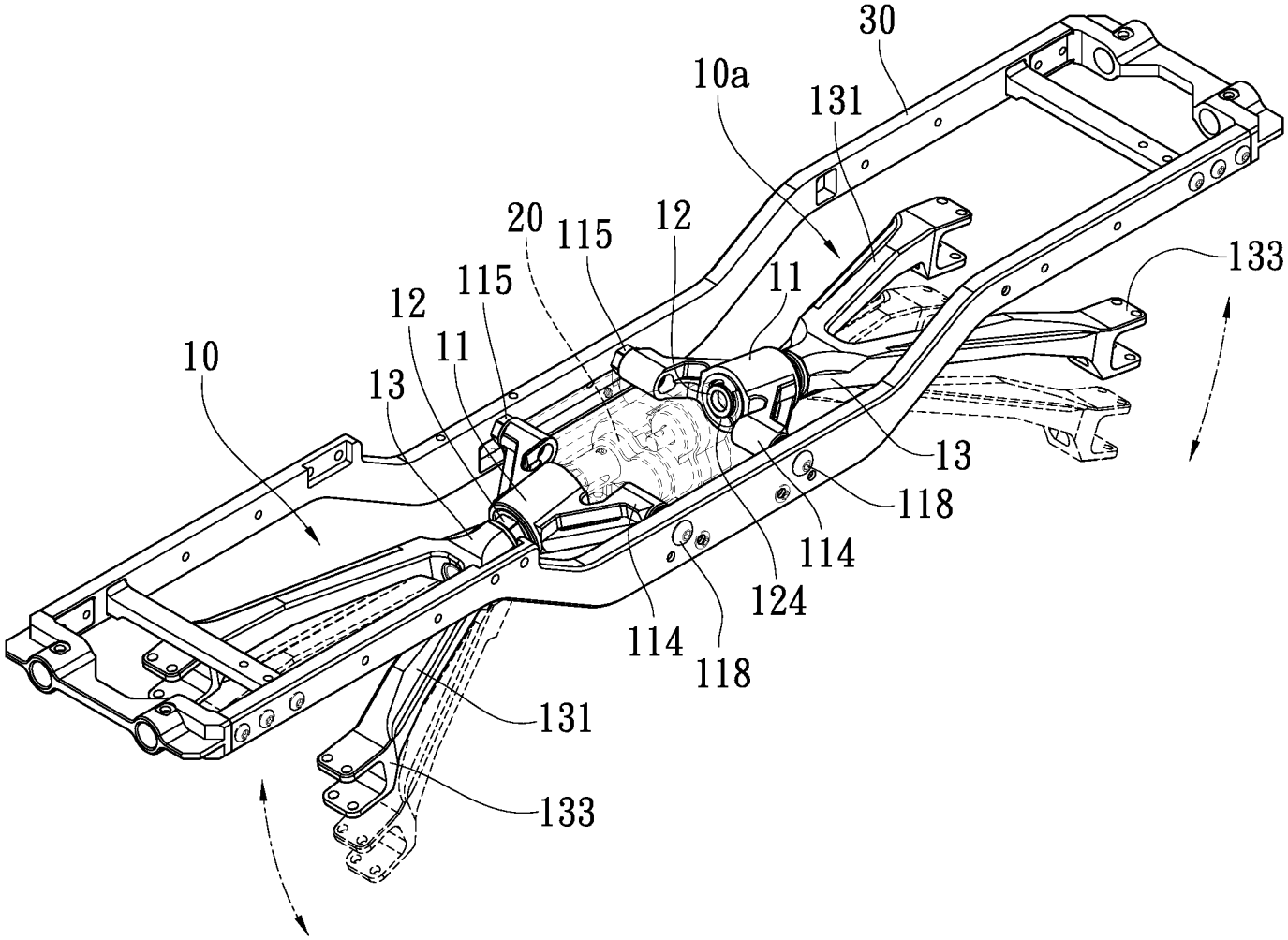
FIG. 4 is a schematic view illustrating up and down swings of the chassis of the present invention.
Figure 5:
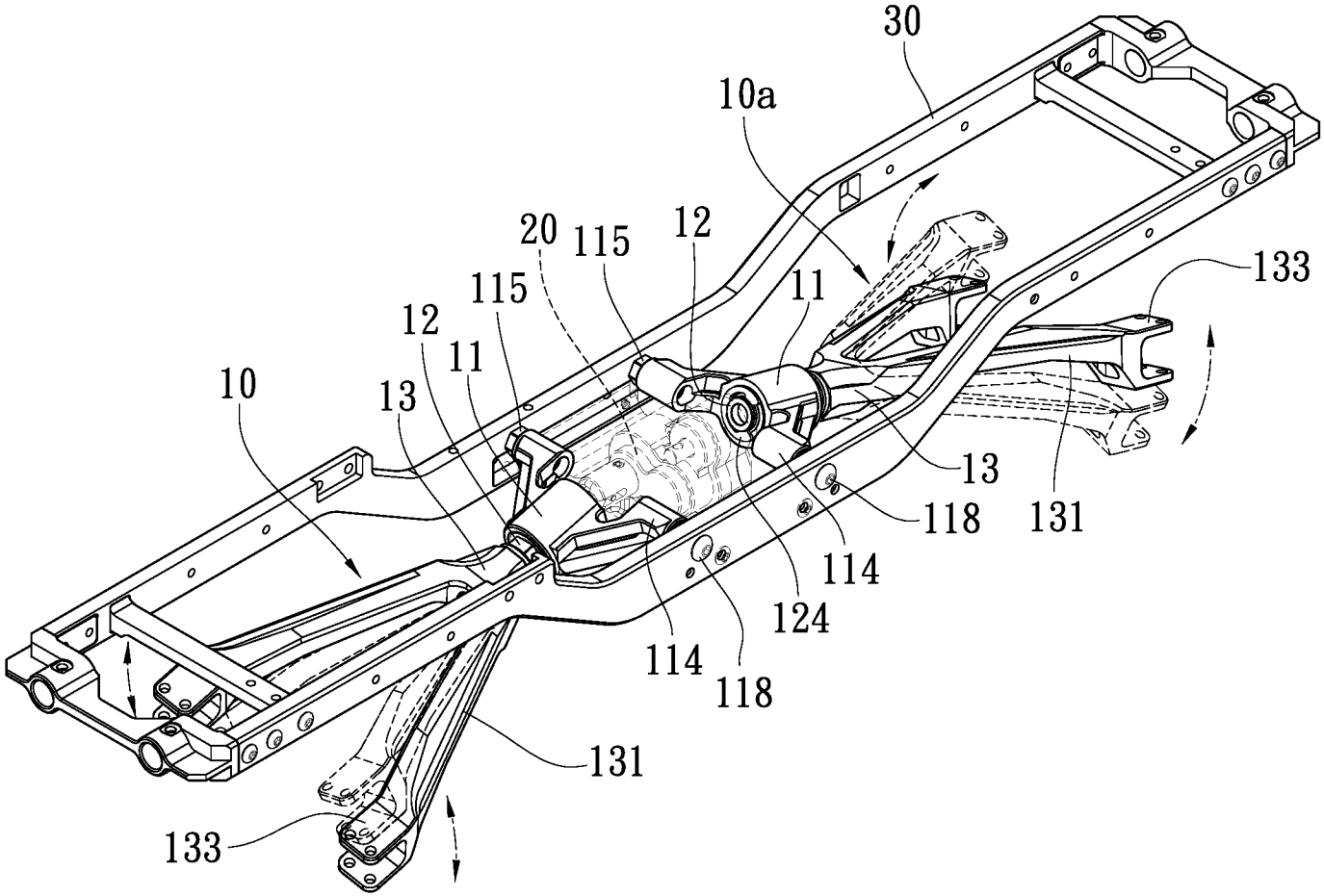
FIG. 5 is a schematic view illustrating leftward and rightward twisting swings of the chassis of the present invention.
Figure 6:
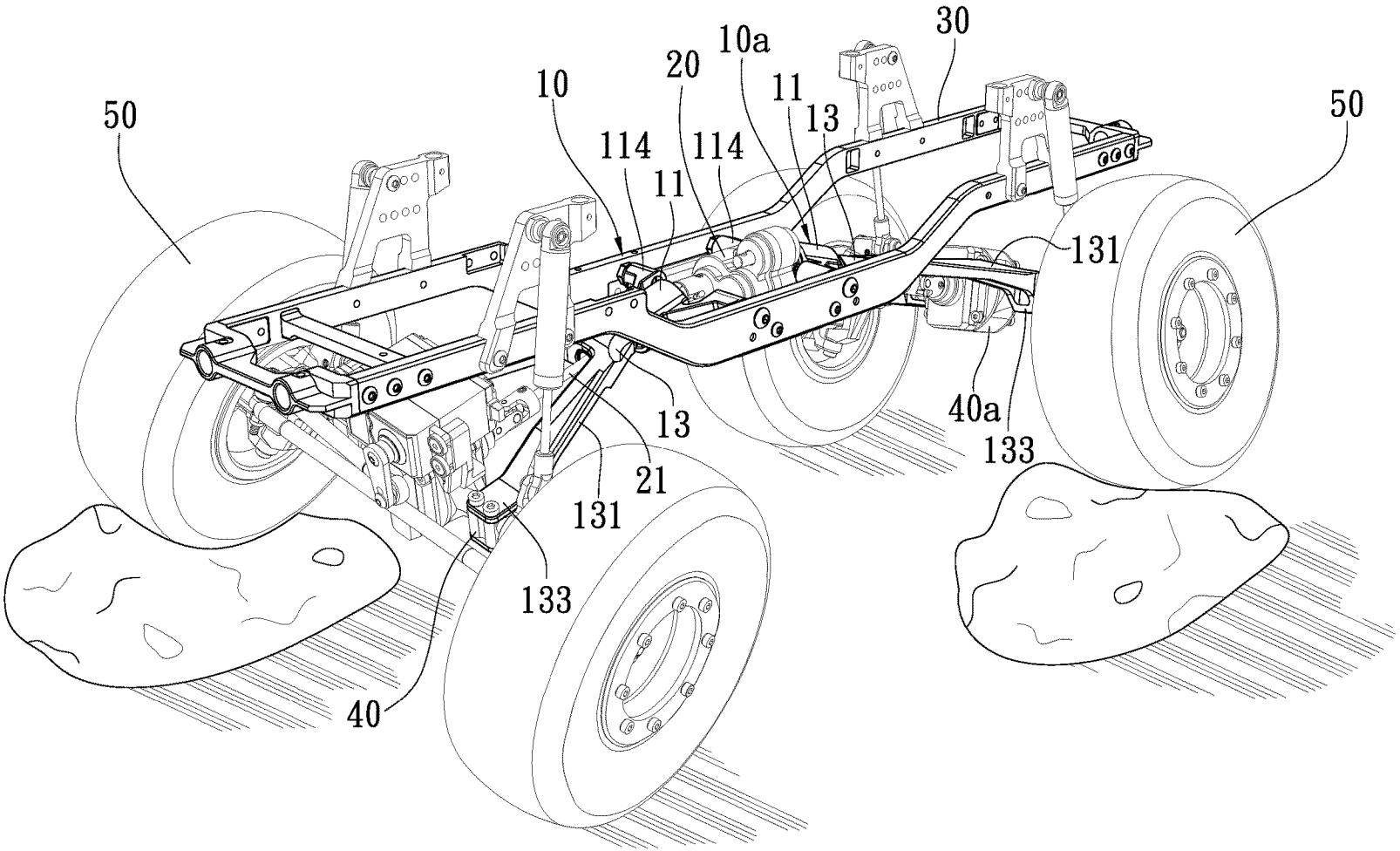
FIG. 6 is a schematic view illustrating an actual application of the present invention.

Referring to FIGS. 4-6, to user the chassis structure of the remote control crawler vehicle according to the present invention, since the front bridge 40 and the rear bridge 40*a* may undergo swings as being affected by the terrain variation where wheels 50 pass over (as shown in FIG. 6), when the front and rear bridges (40, 40*a*) swing up and down, the pivot coupling sections 114 of the swing arm seats 11 of the swing arm assemblies (10, 10*a*) may swing up and down through single axis (as shown in FIG. 4). When the front and rear bridges (40, 40*a*) demonstrate leftward and rightward twisting swing, the rotatable connection of the bridge swing arm 13 with the swing arm seat 11 also allows for leftward and rightward twisting swing through single axis (as shown in FIG. 5). In this way, wear and abrasion among parts of the chassis can be reduced and durability of parts can be enhanced. In addition, the overall structure of the chassis can be enhanced and the flexibility of flexing variation of the entire chassis can be improved to enhance stability of operation and control.

In summary, the present invention provides a chassis structure of a remote control crawler vehicle, which allows the crawler vehicle to demonstrate up and down and twisting swing through single axis by following the terrain variation so as to effectively improve the drawbacks of the conventional multiple-links chassis structures.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A chassis structure of a remote control crawler vehicle, comprising front and rear swing arm assemblies mounted, in a symmetric manner, on a frame at two sides of a central separation driving box and to front and rear bridges of the frame, respectively;

wherein each of the swing arm assemblies comprises a swing arm seat, an axle, and a bridge swing arm, wherein each swing arm seat is formed, in a center thereof, with an axle hole along a vehicle body direction, the axle hole receiving and combined therein with bearings, each swing arm seat comprising pivotal coupling sections provided in radial directions on two opposite sides of the axle hole and each comprising a pivot connection hole formed therein to be pivotally connected to the frame by means of pivots; each bridge swing arm has an end that is coupled, through the axle, to the axle hole of the swing arm seat and an opposite end that is formed with two support arms extending outwards in a V-shape, the support arms each having an end forming a coupling section with each coupling section for coupling with a respective one of the front and rear bridges;

wherein up and down or twisting swing of the front and rear bridges is exhibited in a single axis manner by means of the front and rear swing arm assemblies.

2. The chassis structure of the remote control crawler vehicle according to claim 1, wherein both of the swing arm seats are provided with sleeves that are fit to the pivot connection hole of each of the pivot coupling sections on the two sides thereof and the sleeves have an outer circumference that comprises a clamping section formed thereon and projecting therefrom and an interior in which an internal thread is formed, and the pivots are formed by respective bolts extending through respective locking holes formed in the frame to pivotally connect respective swing arm seats to the frame.

3. The chassis structure of the remote control crawler vehicle according to claim 1, wherein both of the axles are a hollow tubular body and each tubular body has an end having an external surface in which an external threaded section is formed and each tubular body comprises a clip groove in the form of a circumferential recess formed in an opposite end and close to an end face, wherein the end with the clip groove of each axle is inserted into the axle hole of each swing arm seat and coupled with the bearings in a co-axial manner, an axle clip being set in each clip groove to join the axles and the swing arm seats; a common joint portion of each of the two support arms of each bridge swing arm being provided with a threaded hole, such that the external threaded section of the tubular body of each axle is screwable into each threaded hole of each bridge swing arm to achieve a rotatable connection between the bridge swing arms and the swing arm seats.

4. The chassis structure of the remote control crawler vehicle according to claim 3, wherein both of the axles comprise a force application section provided, in a raised form, adjacent to one side of the external threaded section for engagement with a tool.

5. The chassis structure of the remote control crawler vehicle according to claim 1, wherein both of the axle holes have two ends each receiving and combined with a bearing.

* * * * *